US008662162B2

(12) United States Patent
Kellner et al.

(10) Patent No.: US 8,662,162 B2
(45) Date of Patent: Mar. 4, 2014

(54) SEGMENTED COLLAPSIBLE BALL SEAT ALLOWING BALL RECOVERY

(75) Inventors: Justin C. Kellner, Pearland, TX (US); James S. Sanchez, Tomball, TX (US); Robert A. Pena, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 402 days.

(21) Appl. No.: 13/020,040

(22) Filed: Feb. 3, 2011

(65) Prior Publication Data

US 2012/0199341 A1 Aug. 9, 2012

(51) Int. Cl.
*E21B 33/12* (2006.01)
*E21B 34/00* (2006.01)

(52) U.S. Cl.
USPC ..... 166/194; 166/192; 166/328

(58) Field of Classification Search
USPC ..... 166/194, 192, 318, 328, 242.7, 332.4
See application file for complete search history.

(56) References Cited

U.S. PATENT DOCUMENTS

| | | | |
|---|---|---|---|
| 2,812,717 | A | 11/1957 | Brown |
| 3,148,731 | A | 9/1964 | Holden |
| 3,263,752 | A | 8/1966 | Conrad |
| 3,358,771 | A | 12/1967 | Berryman |
| 3,703,104 | A | 11/1972 | Tamplen |
| 3,797,255 | A | 3/1974 | Kammerer, Jr. et al. |
| 3,954,138 | A | 5/1976 | Miffre |
| 3,997,003 | A | 12/1976 | Adkins |
| 4,067,358 | A | 1/1978 | Streich |
| 4,176,717 | A | 12/1979 | Hix |
| 4,190,239 | A | 2/1980 | Schwankhart |
| 4,246,968 | A | 1/1981 | Jessup et al. |
| 4,260,017 | A | 4/1981 | Nelson et al. |
| 4,292,988 | A | 10/1981 | Montgomery |
| 4,355,685 | A | 10/1982 | Beck |
| 4,554,981 | A | 11/1985 | Davies |
| 4,566,541 | A | 1/1986 | Moussy et al. |
| 4,714,116 | A | 12/1987 | Brunner |
| 4,729,432 | A | 3/1988 | Helms |
| 4,823,882 | A | 4/1989 | Stokley et al. |
| 4,856,591 | A | 8/1989 | Donovan et al. |
| 4,893,678 | A | 1/1990 | Stokley et al. |
| 4,944,379 | A | 7/1990 | Haaser |
| 4,979,561 | A | 12/1990 | Szarka |
| 5,029,643 | A | 7/1991 | Winslow et al. |
| 5,230,390 | A | 7/1993 | Zastresek et al. |

(Continued)

FOREIGN PATENT DOCUMENTS

EP 0427422 A2 5/1991

*Primary Examiner* — Kenneth L Thompson
*Assistant Examiner* — Michael Wills, III
(74) *Attorney, Agent, or Firm* — Steve Rosenblatt

(57) ABSTRACT

A series of ball seat assemblies preferably used to open a series of sliding sleeves for formation access to a zone that is to be fractured allows sequential shifting of the sleeves with a single ball. The ball is guided by a tapered member with a lower outlet larger than the ball. The ball lands on the segments that are initially supported. Some leakage occurs between the segments but not enough to prevent pressure buildup to shift the sleeves. The tapered member closely fits to the segments to minimize leakage. Shifting the segments axially allows them to retract so the ball passes to eventually land on a non-leaking seat so that the zone can be fractured. The ball is recovered at the surface after passing the retracted segments and going through the undistorted opening in the tapered member.

18 Claims, 3 Drawing Sheets

(56) References Cited

U.S. PATENT DOCUMENTS

| | | | | |
|---|---|---|---|---|
| 5,305,837 | A | 4/1994 | Johns et al. | |
| 5,335,727 | A | 8/1994 | Cornette et al. | |
| 5,343,946 | A | 9/1994 | Morrill | |
| 5,609,178 | A | 3/1997 | Hennig et al. | |
| 5,775,421 | A | 7/1998 | Duhon et al. | |
| 5,775,428 | A | 7/1998 | Davis et al. | |
| 6,053,250 | A | 4/2000 | Echols | |
| 6,098,713 | A * | 8/2000 | Ross | 166/297 |
| 6,102,060 | A | 8/2000 | Howlett et al. | |
| 6,155,350 | A | 12/2000 | Melenyzer | |
| 6,173,795 | B1 | 1/2001 | McGarian et al. | |
| 6,220,350 | B1 | 4/2001 | Brothers et al. | |
| 6,227,298 | B1 | 5/2001 | Patel | |
| 6,253,861 | B1 | 7/2001 | Carmichael et al. | |
| 6,378,609 | B1 | 4/2002 | Oneal et al. | |
| 6,474,412 | B2 | 11/2002 | Hamilton et al. | |
| 6,634,428 | B2 | 10/2003 | Krauss et al. | |
| 6,644,412 | B2 | 11/2003 | Bode et al. | |
| 6,681,860 | B1 | 1/2004 | Yokley et al. | |
| 6,712,145 | B2 | 3/2004 | Allamon | |
| 6,712,415 | B1 | 3/2004 | Darbishire et al. | |
| 6,983,795 | B2 | 1/2006 | Zuklic et al. | |
| 7,150,326 | B2 | 12/2006 | Bishop et al. | |
| 7,322,408 | B2 | 1/2008 | Howlett | |
| 7,337,847 | B2 | 3/2008 | McGarian et al. | |
| 7,350,578 | B2 | 4/2008 | Szarka et al. | |
| 7,377,321 | B2 | 5/2008 | Rytlewski | |
| 7,416,029 | B2 | 8/2008 | Telfer et al. | |
| 7,464,764 | B2 | 12/2008 | Xu | |
| 7,467,664 | B2 | 12/2008 | Cochran et al. | |
| 7,469,744 | B2 | 12/2008 | Ruddock et al. | |
| 7,503,392 | B2 | 3/2009 | King et al. | |
| 7,520,336 | B2 | 4/2009 | Mondelli et al. | |
| 7,628,210 | B2 | 12/2009 | Avant et al. | |
| 7,637,323 | B2 | 12/2009 | Schasteen et al. | |
| 7,644,772 | B2 | 1/2010 | Avant et al. | |
| 7,730,953 | B2 | 6/2010 | Casciaro | |
| 7,832,472 | B2 | 11/2010 | Themig | |
| 2001/0007284 | A1 | 7/2001 | French et al. | |
| 2004/0007365 | A1 | 1/2004 | Hill et al. | |
| 2005/0072572 | A1 | 4/2005 | Churchill | |
| 2006/0124310 | A1 | 6/2006 | Lopez de Cardenas et al. | |
| 2006/0169463 | A1 | 8/2006 | Howlett | |
| 2007/0007007 | A1 | 1/2007 | Themig et al. | |
| 2007/0012438 | A1 | 1/2007 | Hassel-Sorensen | |
| 2007/0095538 | A1 | 5/2007 | Szarka et al. | |
| 2007/0272413 | A1 | 11/2007 | Rytlewski et al. | |
| 2008/0093080 | A1 | 4/2008 | Palmer et al. | |
| 2008/0190620 | A1 | 8/2008 | Posevina et al. | |
| 2008/0308282 | A1 | 12/2008 | Standridge et al. | |
| 2009/0044949 | A1 | 2/2009 | King et al. | |
| 2009/0056934 | A1 | 3/2009 | Xu | |
| 2009/0056952 | A1 | 3/2009 | Churchill | |
| 2009/0107680 | A1 | 4/2009 | Surjaatmadja | |
| 2009/0159289 | A1 | 6/2009 | Avant et al. | |
| 2009/0308588 | A1 | 12/2009 | Howell et al. | |
| 2009/0308614 | A1 * | 12/2009 | Sanchez et al. | 166/328 |
| 2010/0294514 | A1 | 11/2010 | Crow et al. | |
| 2011/0036590 | A1 * | 2/2011 | Williamson et al. | 166/373 |
| 2011/0073320 | A1 * | 3/2011 | Fay et al. | 166/373 |
| 2011/0108284 | A1 | 5/2011 | Flores et al. | |
| 2011/0180274 | A1 | 7/2011 | Wang et al. | |
| 2011/0198100 | A1 * | 8/2011 | Braekke et al. | 166/386 |
| 2011/0278017 | A1 * | 11/2011 | Themig et al. | 166/373 |

* cited by examiner

SEGMENTED COLLAPSIBLE BALL SEAT ALLOWING BALL RECOVERY

FIELD OF THE INVENTION

The field of this invention is collapsing ball seats and more particularly seats made of collapsing segments where some leakage is tolerated so that a series of operations can take place with an object that can then be recovered with formation flow into a borehole.

BACKGROUND OF THE INVENTION

Ball seats that allow the ball to land and seat to operate a tool with built up pressure against the seated ball and thereafter pass the ball or object past the seat have been used in the past. One example uses a tapering member with a central lower opening that is backed by segments that support the tapered member. The tapered member without the segments supporting it from below would not be strong enough to retain a seated ball at the needed pressure differential across the ball. When the ball is on the seat the pressure is built up to a first level and a tool is operated. After the tool is operated pressure is further raised so that the ball seat assembly breaks a shear pin and moves axially in a manner that allows the dog supports to retract so that pressure on the seated ball extrudes the opening in the seat to the point that the ball can pass. One such system is illustrated in U.S. Pat. No. 6,634,428. The problem with this system is that the seat opening does not extend uniformly as the ball is blown clear so that later when the well is brought in the ball rises to the seat but can still get hung up on the now enlarged but potentially severely misshapen ball seat opening.

Other examples of known designs can be seen in U.S. Pat. Nos. 6,155,350; 7,464,764; 7,469,744; 7,503,392; 7,628,210; 7,637,323 and 7,644,772.

What is needed and provided by the present invention is a ball seat that is made by the retractable segments so that when an object lands on them there is still some leakage in the gaps between the segments but its extent is controlled so that the tool can still be operated with an elevated pressure. Then with an even higher pressure the seat assembly moves axially to let the segments retract and the ball to pass. Also used above the segments is a tapered member with a bottom opening that is larger than the object so that when the object falls the taper guides the object through the opening and onto the supported segments. When the segments translate axially so that they can retract radially the tapered member is not extruded as its original lower end opening was initially larger than the object. Thus, when the well is later brought in from below a series of such assemblies, the ball can be redelivered to the surface without hanging up on ball seats that are so distorted from ball extrusion that they do not permit the ball or object to pass back up the string to the surface. In the preferred system there are a series of such assemblies attached to sliding sleeves to open a zone to be produced to fracturing fluid delivered under pressure. A single ball can open multiple valves and seat below them all to allow pressure buildup in the zone of interest before allowing the ball to be recovered to the surface. Those skilled in the art will better understand the invention from the detailed description of the preferred embodiment and the associated drawings while understanding that the full scope of the invention is to be found in the appended claims.

SUMMARY OF THE INVENTION

A series of ball seat assemblies preferably used to open a series of sliding sleeves for formation access to a zone that is to be fractured allows sequential shifting of the sleeves with a single ball. The ball is guided by a tapered member with a lower outlet larger than the ball. The ball lands on the segments that are initially supported. Some leakage occurs between the segments but not enough to prevent pressure buildup to shift the sleeves. The tapered member closely fits to the segments to minimize leakage. Shifting the segments axially allows them to retract so the ball passes to eventually land on a non-leaking seat so that the zone can be fractured. The ball is recovered at the surface after passing the retracted segments and going through the undistorted opening in the tapered member.

DETAILED DESCRIPTION OF THE PREFERRED EMBODIMENT

Figure 1:
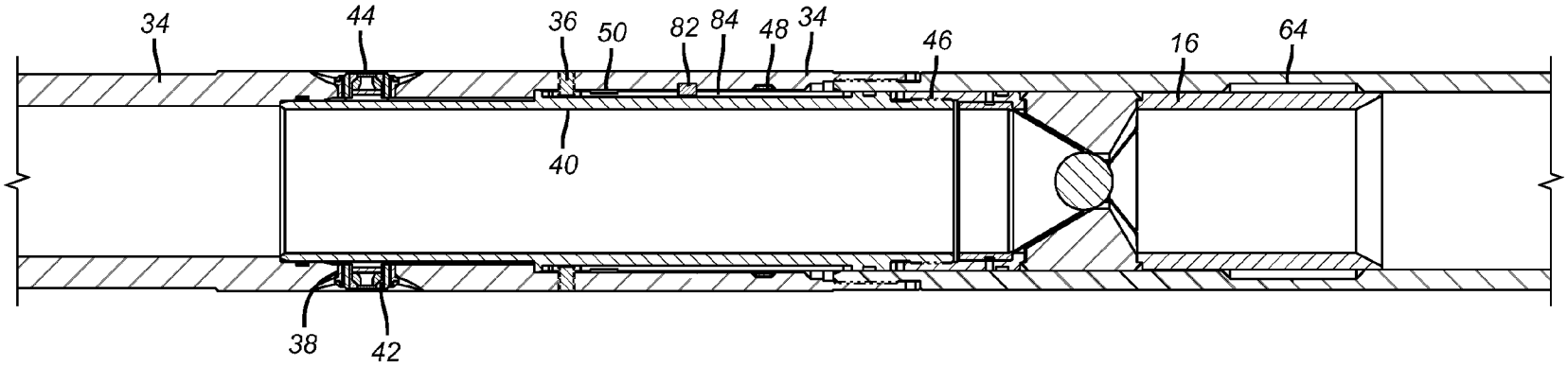
FIG. 1 is a section view of a ball seat assembly with a ball landed on the segments.
Figure 2:
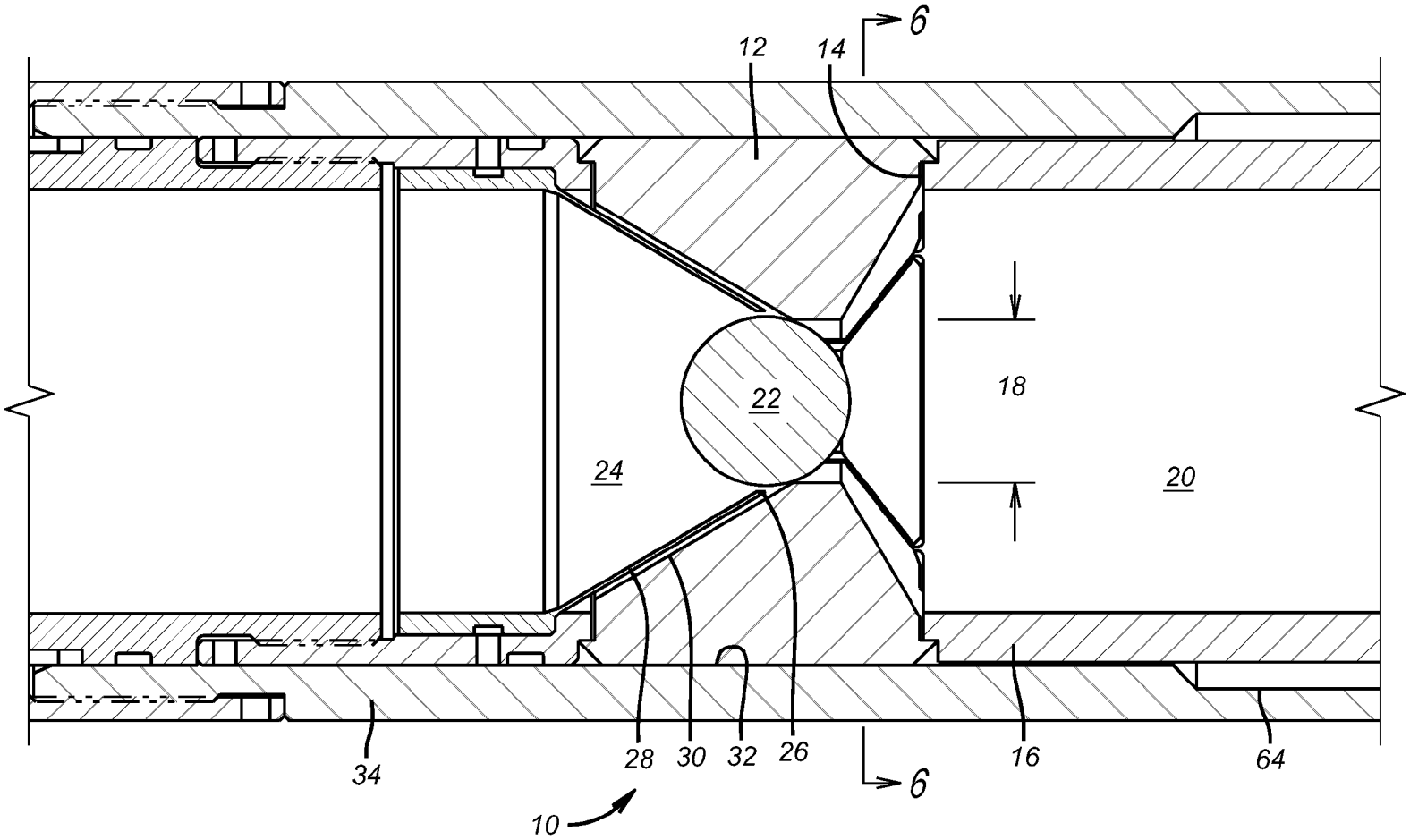
FIG. 2 is a closer view of FIG. 1 showing the ball through a larger opening on the tapered member and landed on the segments.
Figure 3:
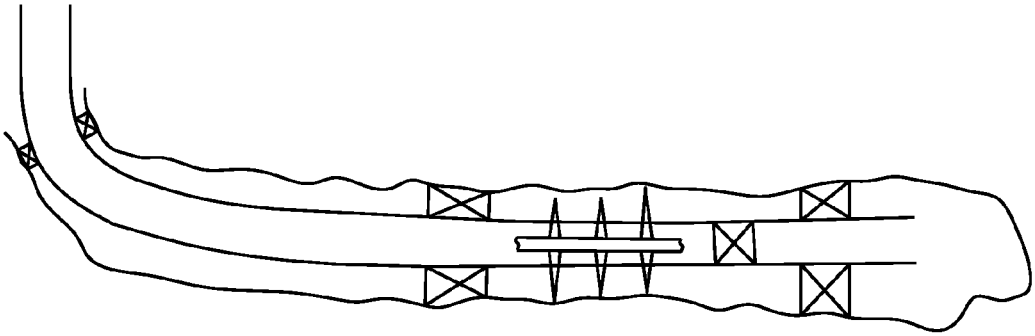
(PRIOR ART) FIG. 3
FIG. 3 is a prior art method using a perforating gun and a composite plug between two packers that define a zone.
Figure 6:
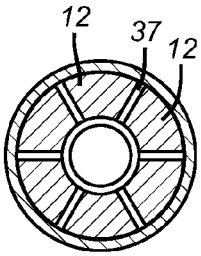
FIG. 6 is a section view through line 6-6 of FIG. 2.

FIG. 2 illustrates a ball seat assembly 10 that has a series of dogs 12 that extend through windows 14 that are circumferentially spaced in the housing wall 16 so as to create a circular opening 18 in the center of the passage 20 that is smaller than the diameter of the ball 22. A tapered component 24 has a lower end opening 26 that is larger than the ball 22. The outer face 28 of the tapered component 24 is closely spaced to the supporting surfaces 30 of the segments 12 when they are supported by surface 32 of the outer housing 34. A shear pin 36 holds the housing 16 to the outer housing 34 as best seen in FIG. 1. The close clearance between the ball 22 and the lower end 26 of the tapered member 24 reduces leak flow when pressure on the ball 22 sitting on the segments 12 is applied. In the FIG. 2 position the segments 12 have small radially extending gaps 37 between them as shown in FIG. 6.

As shown in FIG. 1 the ports 38 are initially covered by the sleeve 40. Optionally a telescoping passage assembly 42 can be put in the ports 38 with a breakable member 44 that aids the telescoping components to extend before breaking, after the sleeve 40 is pushed down with pressure applied on the ball 22 seated on the segments 12 with some leakage flow occurring. Alternatively the telescoping assembly 42 can be extended with flow running through it after sleeve 40 is pushed down. The shear pin 36 has to break to allow movement of the assembly of sleeve 40 secured at thread 46 to the housing 16. A snap ring 48 jumps into groove 50 when shifting sleeve 40 brings them in radial alignment. The assembly of sleeve 40 and housing 16 cannot move in reverse after being shifted with pressure on the ball 22.

Figure 4:
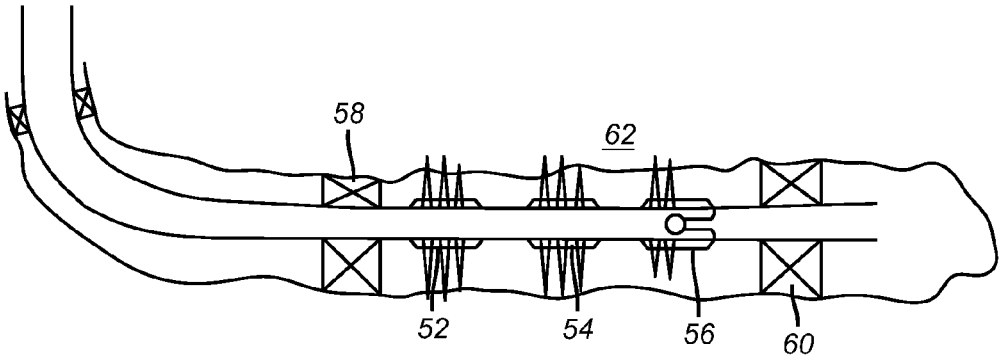
FIG. 4 shows multiple valve seats of the present invention in a single zone.

FIG. 4 shows an array of assemblies such as 10 shown in FIGS. 1 and 2 and now labeled 52 and 54 disposed in zone 62 that is defined between isolation packers 58 and 60. A ball 22 first shifts a sleeve associated with assembly 52 and then shift a sleeve 40 and a housing 16 until the segments 12 align with recess 64 so that ball 22 can pass and land on segments 12 of the assembly 54. After shifting at that location the same ball 22 goes against a seat 56 against which there is by design a complete seal so that pressure can build in the entire zone 62 for fracturing with all the ports 38 exposed that are located between packers 58 and 60.

Figure 5:
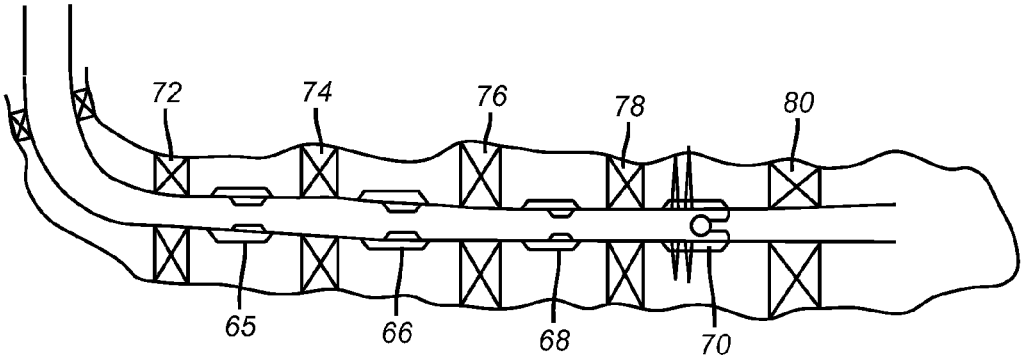
FIG. 5 shows a single ball seat in each of several zones with a non-leaking ball seat at the lower end to allow multiple zones to be fractured at a single time.

FIG. 5 illustrates an array of a single ball actuated assembly as in 10 located between isolation packers. There are sleeve shifting assemblies 65, 66 and 68 followed by a non-leaking ball seat 70. Packers 72 and 74 straddle assembly 65. Packers 74 and 76 straddle assembly 66. Packers 76 and 78 straddle assembly 68. The non-leaking ball seat 70 is between packer 78 and open hole packer 80. The associated openings in the assemblies 65, 66 and 68 are sequentially opened as described before with a ball 22 that ultimately lands on the seat 70 so that all the zones defined between a pair of packers can be fractured. Thereafter, discrete zones can be produced and others closed off from production or if they produce water, for example.

A key 82, shown in FIG. 1, rides in a longitudinal groove 84 to prevent rotation of sleeve 40 in housing 16 if a milling operation takes place. This makes it easier to mill out the segments 12 since they are held in openings 14 in the housing 16. Thread 46 is configured to tighten from mill rotation, again to facilitate milling out.

Those skilled in the art will realize that because the original opening size 18 is larger than the ball 22 that the ball 22 lands on the segments. Axial shifting of the segments allows the ball 22 to pass further downhole without distorting the lower end 26 of the tapered member 24. During axial displacement of the segments 12 so that they can retract into groove 64 the tapered member 24 moves in tandem with the segments 12 to retain the relative position between them. As a result even when the segments 12 retract into groove 64 there is no gap opened between the segments 12 and the tapered member 24 that can trap the ball 22 when it is being brought up to the surface such as during production from below after fracturing is complete. The ball 22 has a clear path through the lower end 26 that was not distorted during pressure buildup. The shifting of sleeve 40 and housing 16 occurs with some leakage tolerated through the gaps 37 between the segments 12, as shown in FIG. 6. The pump rate at the surface is simply increased to compensate for the leakage flow.

While shifting a sleeve 40 to open a port 38 is the preferred application there are many other types of downhole tools that can be pressure operated that can be used in a sequential system of tool actuation where a common object that is preferably a ball 22 but can have other shapes, is sequentially used to operate tools in a specific order while allowing the ball 22 to safely exit the wellbore when flow below it brings it up.

While the preferred embodiment is illustrated in FIG. 1 using dogs 12 through windows 14 that retract into recess 64 an alternative is possible where the seat is formed with a c-ring or a snap ring that has a gap and that can snap radially outwardly when aligned with the recess 64. In essence a snap ring would be equivalent to a single segment with a gap in it, akin to the multiple gaps 37 when using the dogs 12 through windows 14.

The above description is illustrative of the preferred embodiment and many modifications may be made by those skilled in the art without departing from the invention whose scope is to be determined from the literal and equivalent scope of the claims below.

We claim:

1. A selectively actuated barrier for a tubular string in a subterranean location comprising:

a plurality of circumferentially disposed segments supported from a housing and movable from a first position where said segments extend into the tubular string and a second position where said segments retract to enlarge a passage defined by said segments in said housing in said first position;

said segments are spaced apart from each other outside said passage in the second position;

a tapered member mounted in said housing adjacent said segments and having a taper opening larger than said passage, when said segments are in said first position;

an object to land on said segments and substantially block said passage when said segments is in said first position and to pass through said passage when said segment retracts to said second position.

2. The barrier of claim 1, wherein:

said tapered member overlaps said spaces between said segments.

3. The barrier of claim 2, wherein:

said tapered member moves axially in tandem with said segments.

4. The barrier of claim 3, wherein:

said axial movement of said segments allows them to retract to enlarge said passage.

5. The barrier of claim 4, wherein:

said segments extend through respective windows in said housing and axial movement of said housing aligns said windows with a recess in the tubular string to allow said segments to retract.

6. The barrier of claim 1, wherein:

said tapered member guides said object to said passage formed by said segments.

7. The barrier of claim 6, wherein:

said tapered member reduces leakage flow through spaces between said segments when they are in said first position.

8. The barrier of claim 1, wherein:

said segments cannot return to said first position after assuming said second position.

9. The barrier of claim 1, wherein:

said housing is rotationally locked to the tubular string.

10. The barrier of claim 1, wherein:

said object comprises a sphere.

11. The barrier of claim 3, wherein:

said axial movement of said segments is in tandem with said housing for exposure of at least one port in the tubular sting.

12. The barrier of claim 1, wherein:

said plurality of circumferentially disposed segments comprises multiple axially spaced rows of segments each with an adjacent tapered member;

said object sequentially lands on an adjacent row after moving another row of segments into said second position.

13. The barrier of claim 12, wherein:

said object comprises a sphere;

said housing further comprises a solid ball seat in said housing, said sphere sealingly lands on said seat after moving all said rows of segments into said retracted position.

14. The barrier of claim 13, wherein:

said sphere moves with flow from below said solid ball seat to pass through said rows of segments with said segments in all said rows said second position.

15. The barrier of claim 13, wherein:

each of said rows is axially shifted to change from said first to said second position;

said housing comprises a plurality of housings;

each said housing comprising at least one row of segments that shift axially with said housing;

each housing exposing at least one port in the tubular due to said axial shifting.

16. The barrier of claim 1, wherein:

said segments have a top surface disposed generally parallel to said tapered member.

17. The barrier of claim 16, wherein:

said tapered member located adjacent to said segments and movable in tandem with said segments.

18. The barrier of claim 1, wherein:

said object comprises a sphere;

said segments move radially from said first to said second position to enlarge said passage while remaining no further away from said tapered member than the diameter of said sphere after moving to said second position.

* * * * *